US008562374B2

(12) United States Patent
Myer et al.

(10) Patent No.: US 8,562,374 B2
(45) Date of Patent: Oct. 22, 2013

(54) HARNESS CONNECTOR

(75) Inventors: John Mark Myer, Millersville, PA (US); Hurley Chester Moll, Hershey, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/091,909

(22) Filed: Apr. 21, 2011

(65) Prior Publication Data

US 2012/0270433 A1 Oct. 25, 2012

(51) Int. Cl.
*H01R 4/24* (2006.01)

(52) U.S. Cl.
USPC ..... 439/404

(58) Field of Classification Search
USPC ..... 439/404, 405, 402, 417, 680, 540.1, 439/701, 638, 398
See application file for complete search history.

(56) References Cited

U.S. PATENT DOCUMENTS

| | | | | |
|---|---|---|---|---|
| 4,072,379 | A | 2/1978 | Towne et al. | |
| 4,083,615 | A * | 4/1978 | Volinskie | 439/402 |
| 4,159,158 | A | 6/1979 | Weidler | |
| 4,342,495 | A * | 8/1982 | Bennett et al. | 439/689 |
| 4,743,208 | A * | 5/1988 | Weisenburger | 439/398 |
| 4,747,791 | A * | 5/1988 | Nishio | 439/638 |
| 4,923,411 | A * | 5/1990 | Hayashi et al. | 439/540.1 |
| 5,190,472 | A * | 3/1993 | Voltz et al. | 439/579 |
| 5,431,573 | A * | 7/1995 | Endo et al. | 439/157 |
| 5,451,174 | A * | 9/1995 | Bogursky et al. | 439/876 |
| 5,545,053 | A * | 8/1996 | Ishii et al. | 439/364 |
| 5,667,401 | A * | 9/1997 | Kuwabara et al. | 439/405 |
| 5,679,028 | A * | 10/1997 | Yagi et al. | 439/701 |
| 5,957,739 | A * | 9/1999 | Bianca et al. | 439/885 |
| 6,007,374 | A * | 12/1999 | Sukegawa | 439/540.1 |
| 6,027,360 | A * | 2/2000 | Jenkins | 439/364 |
| 6,062,896 | A * | 5/2000 | Huang | 439/405 |
| 6,210,204 | B1 * | 4/2001 | Ko et al. | 439/404 |
| 6,267,628 | B1 * | 7/2001 | Meckley et al. | 439/676 |
| 6,464,542 | B1 * | 10/2002 | Lee | 439/680 |
| 6,583,366 | B2 * | 6/2003 | Saiki | 174/267 |

(Continued)

FOREIGN PATENT DOCUMENTS

| | | |
|---|---|---|
| DE | 103 49 486 A1 | 5/2004 |
| EP | 0 104 013 A1 | 3/1984 |
| EP | 1 162 695 A1 | 12/2001 |
| JP | 10 294138 A | 11/1998 |

OTHER PUBLICATIONS

International Search Report, International Application No. PCT/US2012/033005, International Filing Date Nov. 4, 2012.

*Primary Examiner* — Alexander Gilman

(57) ABSTRACT

A harness connector having a header assembly that includes a header housing that extends between a plug end and a mounting end. The header housing holds header contacts. Optionally, the header housing may be mounted to a printed circuit board at the mounting end with the header contacts being electrically connected to the printed circuit board. One or more plug assemblies are received in the plug end of the header housing along a plug axis. The plug assembly includes a plug housing holding receptacle terminals. The receptacle terminals extend along terminal axes parallel to the plug axis between mating ends and terminating ends. The mating ends are mated with corresponding header contacts. The terminating ends have insulation displacement contacts configured to receive, and be electrically connected to, corresponding wires. The wires extend from the insulation displacement contacts along wire axes that are generally perpendicular to the terminal axes.

18 Claims, 8 Drawing Sheets

(56) References Cited

U.S. PATENT DOCUMENTS

| | | | | |
|---|---|---|---|---|
| 6,848,950 | B2 * | 2/2005 | Allison et al. | 439/682 |
| 6,875,044 | B1 * | 4/2005 | Lee | 439/404 |
| 7,261,585 | B2 * | 8/2007 | Yamanashi et al. | 439/404 |
| 7,575,474 | B1 * | 8/2009 | Dodson et al. | 439/581 |
| 7,645,160 | B2 * | 1/2010 | Tabet | 439/540.1 |
| 2001/0012726 | A1 * | 8/2001 | O'Neal et al. | 439/540.1 |
| 2005/0101171 | A1 | 5/2005 | Ramsey et al. | |
| 2009/0137154 | A1 * | 5/2009 | Hashim | 439/620.19 |
| 2009/0149066 | A1 * | 6/2009 | Yi et al. | 439/607.23 |

* cited by examiner

HARNESS CONNECTOR

BACKGROUND OF THE INVENTION

The subject matter herein relates generally to harness connectors.

Harness connectors are used in different applications, including automotive applications. Typically harness connectors include header connectors and plug connectors that are mated to the header connectors. The plug connectors are typically wire mounted to wires of a wire harness. The plug connectors include terminals that are crimped to ends of the wires and loaded into the plug connectors. The wires extend from the plug connectors in a direction along the axes of the terminals. Due to space constraints in some applications, having such plug connectors with the wires extending therefrom are undesirable or potentially unusable.

A need remains for a harness connector system that has a low profile. A need remains for harness connectors that may be manufactured and assembled in a cost effective and reliable manner.

BRIEF DESCRIPTION OF THE INVENTION

In one embodiment, a harness connector is provided having a header assembly including a header housing that extends between a plug end and a mounting end. The header housing holds header contacts. Optionally, the header housing may be mounted to a printed circuit board at the mounting end with the header contacts being electrically connected to the printed circuit board. One or more plug assemblies are received in the plug end of the header housing along a plug axis. The plug assembly includes a plug housing that holds receptacle terminals. The receptacle terminals extend along terminal axes parallel to the plug axis between mating ends and terminating ends. The mating ends are mated with corresponding header contacts. The terminating ends have insulation displacement contacts configured to receive, and be electrically connected to, corresponding wires. The wires extend from the insulation displacement contacts along wire axes that are generally perpendicular to the terminal axes.

In another embodiment, a harness connector is provided having a header assembly including a header housing that extends between a plug end and a mounting end. The header housing has a first plug chamber and a second plug chamber that extends between the plug end and the mounting end. The header housing holds header contacts in the first and second plug chambers. The header housing is configured to be mounted to a printed circuit board at the mounting end with the header contacts being electrically connected to the printed circuit board. A first plug assembly is received in the first plug chamber through the plug end of the header housing along a plug axis. A second plug assembly is received in the second plug chamber through the plug end of the header housing along a plug axis. The first and second plug assemblies each include a plug housing that holds receptacle terminals. The receptacle terminals extend along terminal axes parallel to the plug axis between mating ends and terminating ends. The mating ends are mated with corresponding header contacts. The terminating ends have insulation displacement contacts configured to receive, and be electrically connected to, corresponding wires. The wires extend from the insulation displacement contacts along wire axes that are generally perpendicular to the terminal axes. The first and second plug assemblies are received in the first and second plug chambers in a staggered relationship with the second plug assembly positioned further from the mounting end of the header housing than the first plug assembly. The wires extending from the second plug assembly extend over the plug housing of the first plug assembly.

In a further embodiment, a harness connector is provided having a header assembly that includes a header housing extending between a plug end and a mounting end. The header housing is configured to be mounted to a printed circuit board at the mounting end. The header assembly includes header contacts that are stamped in an L-shape. The header contacts each include a pin and a tail that extends from the pin approximately perpendicular therefrom. The pin is received in the header housing. The tail is configured to be surface mounted to the printed circuit board. A plug assembly is received in the plug end of the header housing along a plug axis. The plug assembly includes a plug housing that holds receptacle terminals. The receptacle terminals extend along terminal axes parallel to the plug axis between mating ends and terminating ends. The mating ends are mated with corresponding pins of the header contacts.

DETAILED DESCRIPTION OF THE INVENTION

Figure 1:
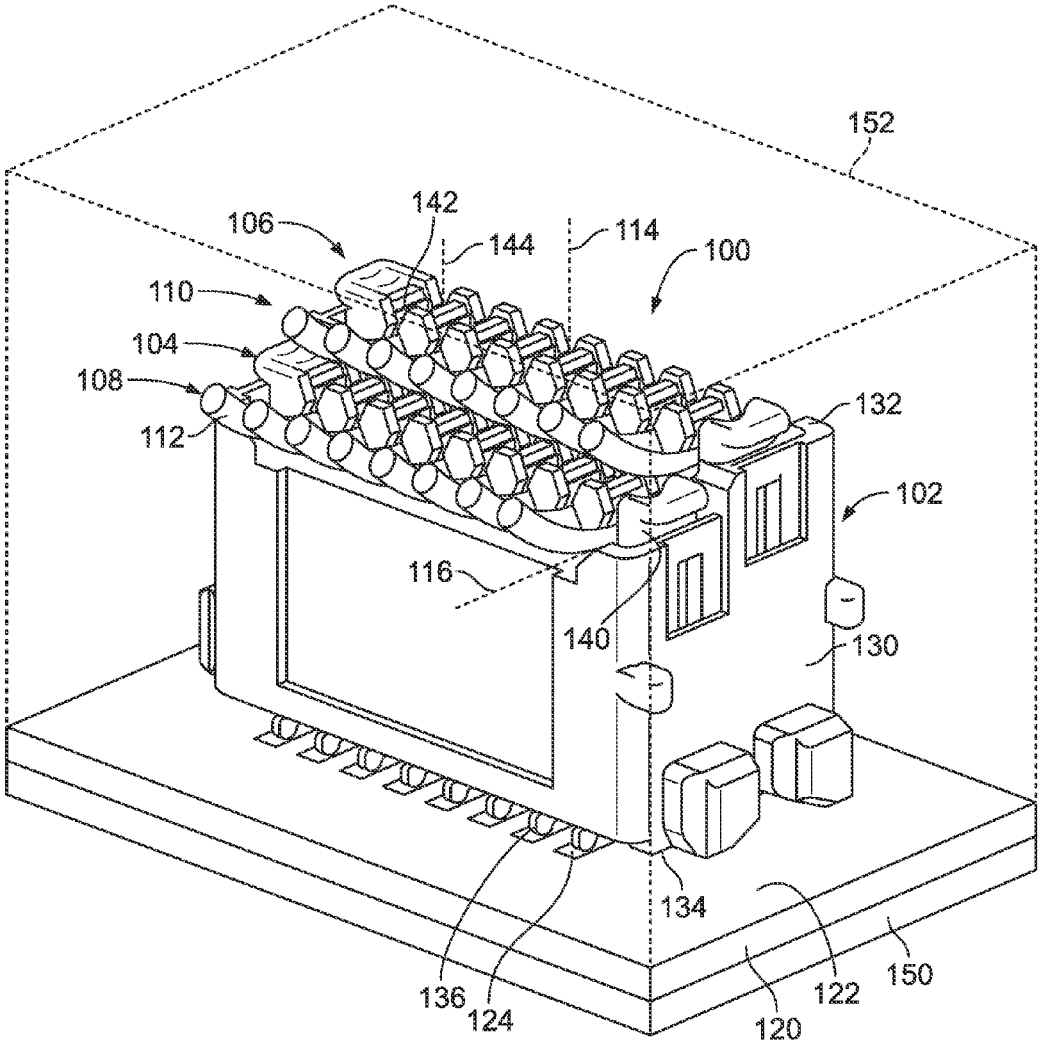
FIG. 1 is a perspective view of a harness connector formed in accordance with an exemplary embodiment.

FIG. 1 is a perspective view of a harness connector 100 formed in accordance with an exemplary embodiment. The harness connector 100 includes a header assembly 102 and a plurality of plug assemblies 104, 106 mated with the header assembly 102. The header assembly 102 may be configured to be mated with any number of plug assemblies in alternative embodiments.

Wire harnesses 108, 110 are terminated to the plug assemblies 104, 106, respectively. Each wire harness 108, 110 include a plurality of wires that may be bundled together. In an exemplary embodiment, the plug assemblies 104, 106 constitute right angle plug assemblies wherein the wires 112 extend generally perpendicular from the plug assemblies 104, 106. For example, the plug assemblies 104, 106 generally extend along plug axes 114 and the wires 112 generally extend along wire axes 116 that are perpendicular to the plug axes 114. It should be noted that downstream of the termination point of the wires 112, the wires 112 may be routed in any direction, including a direction that is parallel to the plug axes 114, however, at the termination point of the wires 112, the wire axes 116 are perpendicular to the plug axes 114. Having the wire axes 116 perpendicular to the plug axes 114 allows the overall height (e.g., along the plug axes 114) of the harness connector 100 to be minimized.

The header assembly 102 is surface mounted to a printed circuit board (PCB) 120. The PCB 120 includes an outer surface 122 having a plurality of mounting pads 124. The header assembly 102 includes a header housing 130 extending between a plug end 132 and a mounting end 134. The header housing 130 holds a plurality of header contacts 136 therein. The header housing 130 is mounted to the PCB 120 at the mounting end 134. The header contacts 136 are exposed along the mounting end 134 and are electrically connected to the mounting pads 124 of the PCB 120. In an exemplary embodiment, the header contacts 136 are soldered to the mounting pads 124. The header contacts 136 may be terminated to the PCB 120 by alternative means in alternative embodiments. In some alternative embodiments, the header contacts 136 may be through-hole mounted to the PCB 120 rather than being surface mounted. In other alternative embodiments, rather than mounting to a PCB, the header housing 130 may be mounted or terminated to a cable with the header contacts 136 terminated to individual wires in the cable or to individual cables.

In an exemplary embodiment, the plug assemblies 104, 106 may be substantially identical to one another. The description herein focuses on the plug assembly 104, however the plug assembly 106 may include identical or similar features as the plug assembly 104. The plug assembly 104 is received in the plug end 132 of the header housing 130 along the plug axes 114. The plug assembly 104 includes a plug housing 140 that holds a plurality of receptacle terminals 142. The receptacle terminals 142 extend along terminal axes 144 that are generally parallel to the plug axes 114. The receptacle terminals 142 are configured to be mated to corresponding header contacts 136. The receptacle terminals 142 are configured to be terminated to corresponding wires 112. In an exemplary embodiment, as described in further detail below, the wires 112 are configured to be terminated to the receptacle terminals 142 by an insulation displacement connection. The wires 142 extend from the receptacle terminals 142 in a direction generally perpendicular to the terminal axes 144.

In an exemplary embodiment, the plug assemblies 104, 106 are received in the header housing 130 in a staggered configuration. The plug assembly 104 is recessed below the plug assembly 106. The plug assembly 106 is elevated above the plug assembly 104, generally further from the PCB 120. Having the plug assembly 106 elevated above the plug assembly 104 allows the wires 112 extending from the plug assembly 106 space to extend from the side of the plug housing 140 and pass above the plug assembly 104. As such, the wires 112 from the plug assemblies 104, 106 extend in the same direction. The wires 112 may extend in opposite directions in alternative embodiments.

The harness connector 100 may have use in many different types of applications. In one particular application, the harness connector 100 is used in an automotive application. For example, the harness connector 100 may be used as part of a rearview mirror connector system, and may be housed within a rearview mirror. The PCB 120 may be mounted directly to a back side of a mirror 150 with the PCB 120 and harness connector 100 being positioned within the mirror housing 152 (shown in phantom in FIG. 1). The wire harnesses 108, 110 may extend through a mounting post (not shown) that is used to attach the rearview mirror to a windshield. During assembly of the rearview mirror, the wire harnesses 108, 110 and the plug assemblies 104, 106 may be passed through the mounting post, which has a small inner diameter, and which may house other components, such as other wire harnesses or connectors. Due to the size constraints, it may be beneficial to provide the harness connector 100 with multiple plug assemblies 104, 106 rather than a single plug assembly having receptacle terminals 142 along two rows. For example, by using two plug assemblies 104, 106, the plug assemblies 104, 106 may be proximately half as wide as a plug assembly that had two rows of receptacle terminals 142 for mating with the header assembly 102. Such narrow design of the plug assemblies 104, 106 may allow the plug assemblies 104, 106 to more easily pass through the mounting post of the rearview mirror for mating with the header assembly 102 than a system that uses a wider plug assembly holding all of the receptacle terminals 142.

In an exemplary embodiment, when the rearview mirror is assembled, the mirror housing 152 may abut against the plug assemblies 104, 106 to hold the plug assemblies 104, 106 in the header housing 130. The mirror housing 152 may resist backing out of the header housing 130 of the plug assemblies 104, 106. The mirror housing 152 may operate as a backup securing feature in addition to other securing features of the header housing 130 and/or the plug assemblies 104, 106.

Figure 2:
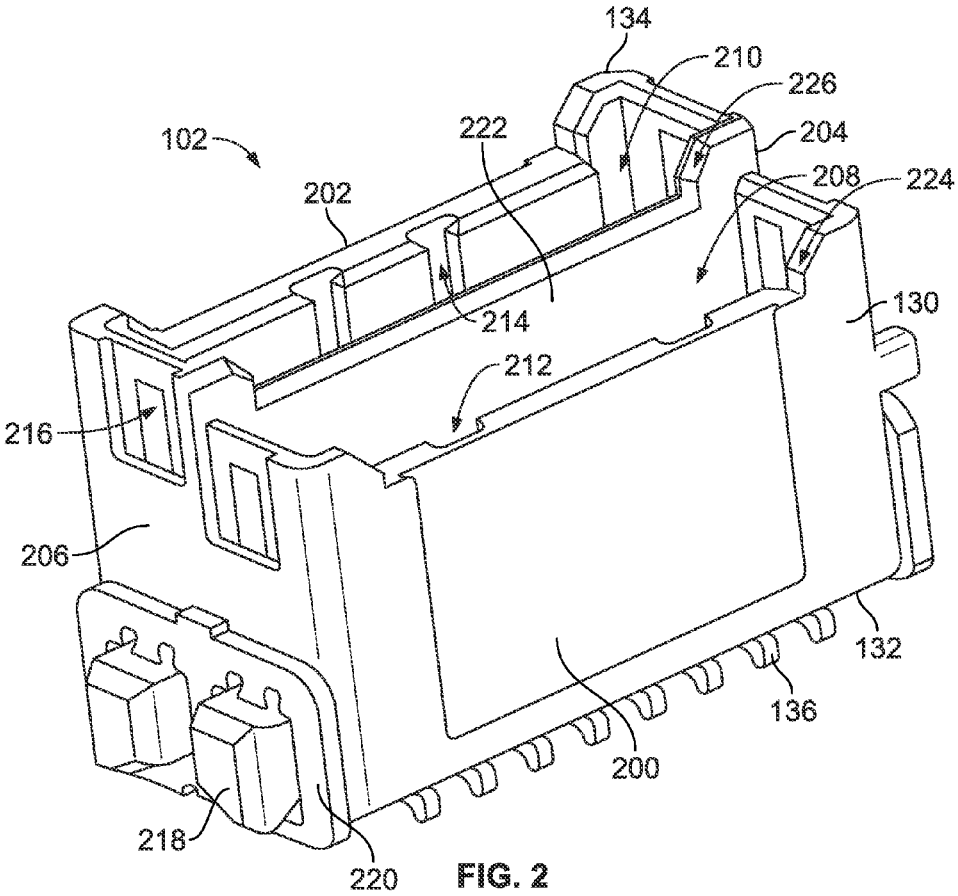
FIG. 2 is a front is perspective view of a header assembly for the harness connector shown in FIG. 1 formed in accordance with an exemplary embodiment.

FIG. 2 is a front perspective view of the header assembly 102 formed in accordance with an exemplary embodiment. The header assembly 102 includes the header housing 130 holding the header contacts 136. The header housing 130 is manufactured from a dielectric material, such as a plastic material. The mounting end 134 is provided at a bottom of the header housing 130. The plug end 132 is provided at a top of the header housing 130. The header housing 130 includes a front 200 and a rear 202 opposite the front 200. The header housing 130 includes opposite sides 204, 206 that extend between the front 200 and the rear 202.

The header housing 130 includes first and second chambers 208, 210 that receive the plug assemblies 104, 106 (shown in FIG. 1), respectively. In the illustrated embodiment, the second chamber 210 is taller than the first chamber 208. The second chamber 210 is elevated with respect to the first chamber 208. In an exemplary embodiment, the header contacts 136 extend from the mounting end 134 into the chambers 208, 210. The chambers 208, 210 include keying features 212, 214, respectively. The keying features 212 are used to properly position the plug assembly 104 in the first chamber 208. The keying features 214 are used to properly position the plug assembly 106 in the second chamber 210. In an exemplary embodiment, the keying features 212, 214 are different than one another to key mating of the plug assemblies 104, 106 with the header assembly 102. For example, the keying features 212 are spread further apart than the keying features 214. The keying features 212 are positioned closer to the sides 204, 206, while the keying features 214 are positioned closer the center of the rear 202. The plug assemblies 104, 106 include corresponding keying features, as described in further detail below, such that the plug assembly 104 can only be received in the first chamber 208 and is restricted from being loaded into the second chamber 210. Similarly, the second plug assembly 106 can only be received in the second chamber 210, and is restricted from being loaded into the first chamber 208.

The header housing 130 includes slots 216 formed in the sides 204, 206. The slots 216 define latching features for securing the plug assemblies 104, 106 in the header housing 130. Other types of latching features may be used in alternative embodiments to secure the plug assemblies 104, 106 in the header housing 130.

The header housing 130 includes mounting posts 218 extending from the sides 204, 206. Solder clips 220 are secured to the mounting posts 218. The solder clips 220 are configured to be soldered to the PCB 120 (shown in FIG. 1) to secure the header housing 130 to the PCB 120.

The header housing 130 includes an intermediate wall 222 separating the first and second chambers 208, 210. The front 200 includes a window 224 that is open at the plug end 132. When the plug assembly 104 is loaded into the first chamber 208, the wires 112 (shown in FIG. 1) extend through the window 224. The intermediate wall 222 includes a window 226. When the second plug assembly 106 is loaded into the second chamber 210, the wires 112 extending therefrom extend through the window 226. The window 226 is open at the plug end 132.

Figure 3:
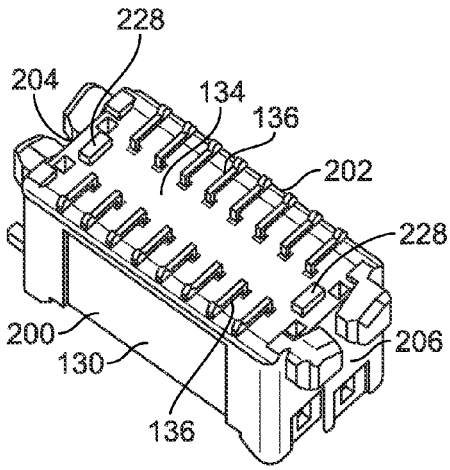
FIG. 3 is a bottom perspective view of a header housing for the harness connector shown in FIG. 1.

FIG. 3 is a bottom perspective view of the header housing 130. The header housing 130 includes mounting pads 228 extending from the mounting end 134. In the illustrated embodiment, the mounting pads 228 are provided proximate to the sides 204, 206 between the rows of header contacts 136. The mounting pads 228 are generally centrally located between the front 200 and the rear 202. The mounting pads 228 are generally coplanar with the header contacts 136. When the header housing 130 is mounted to the PCB 120 (shown in FIG. 1), the mounting pads 228 may rest on the outer surface 122 (shown in FIG. 1) of the PCB 120. Alternatively, the mounting pads 228 may be slightly elevated above the outer surface 122. Epoxy may be applied to the mounting end 134 of the header housing 130 around the mounting pads 228. The epoxy may be applied to the side walls and/or bottom of the mounting pads 228. When the header housing 130 is mounted to the PCB 120 the epoxy around the mounting pads 228 is used to secure the header housing 130 to the PCB 120. Optionally, the epoxy may be used to secure the header housing 130 to the PCB 120 in lieu of using the solder clips 220 (shown in FIG. 2). Alternatively, the epoxy may be used in addition to the solder clips 220.

Figure 4:
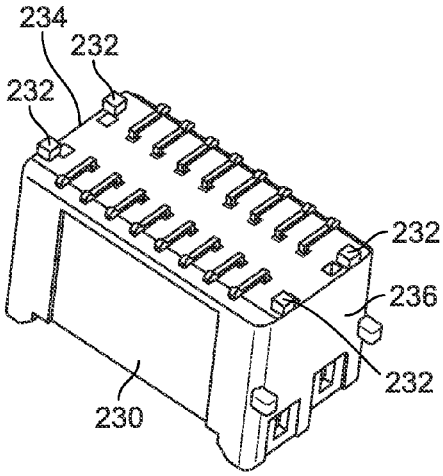
FIG. 4 is a bottom perspective of a header housing for the harness connector shown in FIG. 1.

FIG. 4 is a bottom perspective of a header housing 230. The header housing 230 is similar to the header housing 130. The header housing 230 includes different mounting pads 232 than the header housing 130. The mounting pads 232 are provided at sides 234, 236 of the header housing 230. In the illustrated embodiment, four mounting pads 232 are provided, and the mounting pads 232 are aligned with both rows of header contacts 136. The header housing 230 does not include any mounting posts for solder clips. Rather, the header housing 230 is configured to be secured to the PCB 120 (shown in FIG. 1) using epoxy that is applied around the mounting pads 232. Other configurations of mounting pads 232 are possible in alternative embodiments.

Figure 5:
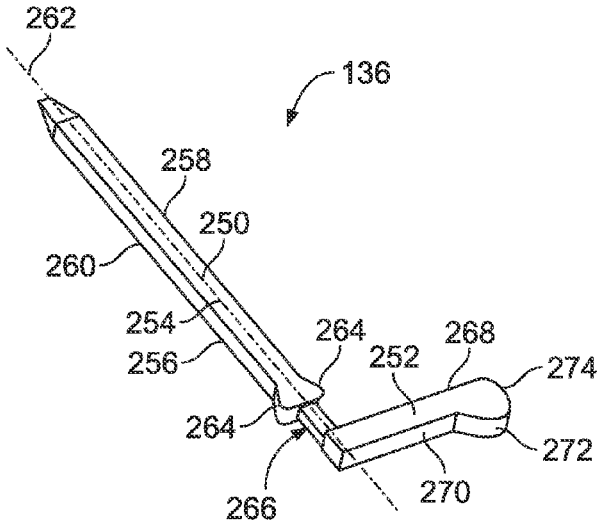
FIG. 5 is a perspective view of a header contact formed in accordance with an exemplary embodiment.

FIG. 5 is a perspective view of one of the header contacts 136 formed in accordance with an exemplary embodiment. The header contact 136 has an L-shaped body including a pin 250 and a tail 252 that extends substantially perpendicular from the pin 250. In an exemplary embodiment, the header contact 136 is a stamped contact, which is stamped into the L-shape illustrated in FIG. 5. No forming or bending is required to define the pin 250 or the tail 252.

The header contact 136 includes a first side 254 and a second side 256 opposite the first side 254. The first and second sides 254, 256 are the untouched or non-sheared surfaces of the blank used to form the header contact 136. The header contact 136 includes shear edges 258, 260 that extend between the first and second sides 254, 256. The shear edges 258, 260 are defined by the cut of the blank during the stamping process. The shear edges 258, 260 may not be as smooth as the first and second sides 254, 256. In an exemplary embodiment, it is preferred that the receptacle terminals 142 (shown in FIG. 1) engage the first side 254 and/or the second side 256 rather than the shear edges 258, 260 as the first and second sides 254, 256 are smoother than the shear edges 258, 260.

The pin 250 extends along a pin axis 262. The pin 250 includes protrusions 264. In the illustrated embodiment, the protrusions 264 are provided proximate to the bottom of the pin 250. In an exemplary embodiment, the pin 250 includes a necked-down portion 266 at the bottom of the pin 250 proximate to the tail 252. The necked-down portion 266 has a reduced cross section as compared to the pin 250 and/or the tail 252. The necked-down portion 266 allows the header contact 136 to more easily flex or bend at such location (e.g., the intersection between the pin 250 and the tail 252).

The tail 252 includes a top 268 and a bottom 270. A solder tab 272 extends from the bottom 270 of the tail 252 proximate to a distal end 274 of the tail 252. The solder tab 272 is a bump or protrusion along the bottom 270 of the tail 252. The solder tab 272 is configured to be soldered to the mounting pad 124 (shown in FIG. 1) of the PCB 120 (shown in FIG. 1). In an exemplary embodiment, the solder tab 272 has a curved surface to allow for a good contact with the mounting pad 124 at different angular positions of the tail 252.

Figure 6:
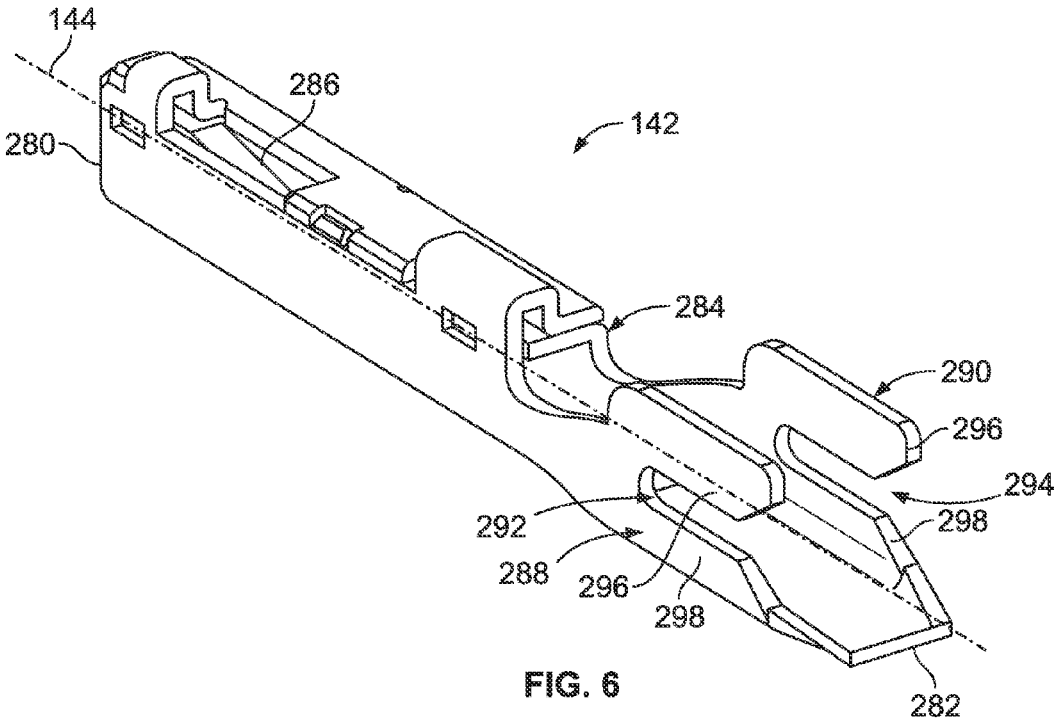
FIG. 6 is a side perspective view of a receptacle terminal formed in accordance with an exemplary embodiment.

FIG. 6 is a side perspective view of one of the receptacle terminals 142 formed in accordance with an exemplary embodiment. The receptacle terminals 142 extends along the terminal axis 144 between a mating end 280 and a terminating end 282. The mating end 280 is configured to be mated with a corresponding header contact 136 (shown in FIG. 5). The terminating end 282 is configured to be electrically connected to a corresponding wire 112 (shown in FIG. 1).

The receptacle terminals 142 includes a socket 284 at the mating end 280. The socket 284 is configured to receive the pin 250 (shown in FIG. 5) of the header contact 136. In the illustrated embodiment, the socket 284 is defined by four perpendicular walls. In an exemplary embodiment, the receptacle terminals 142 is stamped and formed with the four walls being bent to form the socket 284. The receptacle terminals 142 includes one or more mating fingers 286 extending into the socket 284. The mating fingers 286 are deflectable and are configured to engage the pin 250 when the pin 250 is loaded into the socket 284. The mating finger 286 has one or more points of contacts with the pin 250 to ensure electrical connection between the receptacle terminals 142 and the header contact 136. In an exemplary embodiment, the mating fingers 286 is configured to engage either the first side 254 or the second side 256 (both shown in FIG. 5) of the pin 250, as opposed to the shear edges 258, 260 (shown in FIG. 5).

The terminating end 282 includes a first insulation displacement contact 288 and a second insulation displacement contact 290. The insulation displacement contacts 288, 290 receive, and are electrically connected to, corresponding wires 112. The insulation displacement contacts 288, 290 pierce an insulator of the wire 112 to engage a conductor of the wire 112. The first insulation displacement contact 288 defines a first slot 292 and the second insulation displacement contact 290 defines a second slot 294. The slots 292, 294 are open at the top of the receptacle terminals 142. The slots 292, 294 are defined by arms 296, 298 on opposite sides of the slots 292, 294. The arms 296, 298 pierce the insulation, while the conductor is received in the slots 292, 294. Optionally, one or both arms 296, 298 may be deflectable to exert a biasing force against the conductor when the wire 112 is received in the slots 292, 294. In the illustrated embodiment, the slots 292, 294 are aligned with one another along an axis that is perpendicular to the terminal axis 144. Optionally, the first and second slots 292, 294 may be offset such that the wire 112 is kinked or bent between the first and second slots 292, 294. Such kink or bend may provide additional retention for the wire 112 within the receptacle terminals 142.

Figure 7:
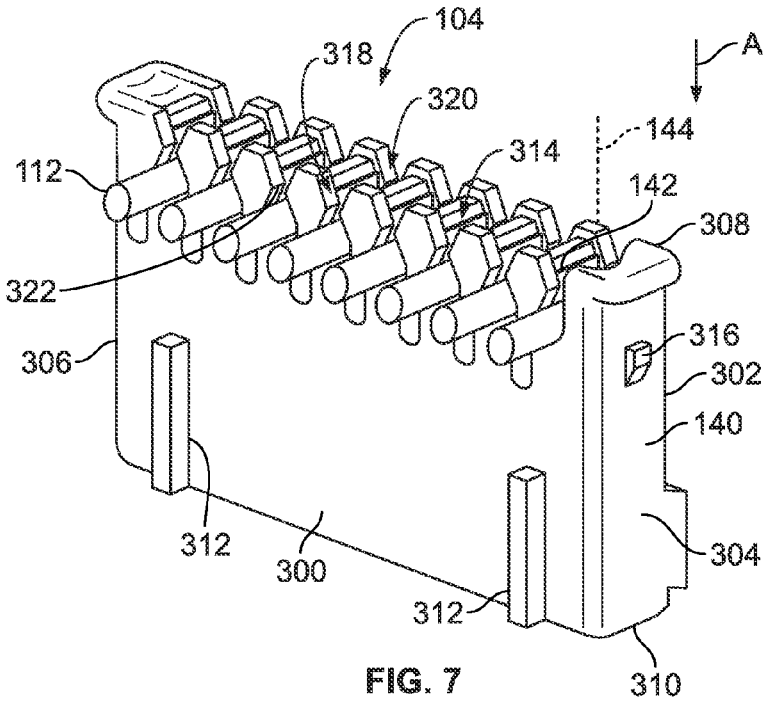
FIG. 7 is a front perspective view of a plug assembly for the harness connector shown in FIG. 1.

FIG. 7 is a front perspective view of the plug assembly 104 showing the plug housing 140, receptacle terminals 142 and wires 112. The receptacle terminals 142 are loaded into the plug housing 140 and the wires 112 extend from the receptacle terminals 142 and the plug housing 140. The plug housing 140 includes a front 300 and a rear 302.

In an alternative embodiment, the receptacle terminals 142 may include a single insulation displacement contact, as opposed to the redundant first and second insulation displacement contacts 288, 290 illustrated in FIG. 6. Having redundant insulation displacement contacts 288, 290 provide multiple points of contact with the wire 112. Having two insulation displacement contacts 288, 290 provides a more secure connection between the receptacle terminals 142 and the wire 112 than a single insulation displacement contact. Optionally, more than two insulation displacement contacts may be provided in alternative embodiments.

The plug housing 140 includes opposite sides 304, 306 that extend between the front 300 and the rear 302. The plug housing 140 includes an outer end 308 at a top thereof and an inner end 310 at a bottom thereof. The inner end 310 is configured to be plugged into the header housing 130 (shown in FIG. 2). The terminal axes 144 extend between the outer and inner ends 308, 310. The front 300, rear 302 and sides 304, 306 extend generally parallel to the terminal axes 144.

The plug housing 140 includes keying features 312 extending from the front 300. The keying features 312 are configured to interact with keying features 212 (shown in FIG. 2) of the header housing 130 to orient the plug assembly 104 within the header housing 130. In the illustrated embodiment, the keying features 312 are tabs extending outward from the front 300. Other types of keying features are possible in alternative embodiments. It should be noted that the plug assembly 106 (shown in FIG. 1) may include different keying features than the keying features 312 for orienting the plug assembly 106 with respect to the header housing 130.

The plug housing 140 includes a plurality of terminal channels 314 that receive corresponding receptacle terminals 142. The terminals channels 314 extend along the terminal axes 144. The terminal channels 314 are separated from one another by interior walls of the plug housing 140. The receptacle terminals 142 are loaded into the terminal channels 314 through the outer end 308.

The plug housing 140 includes detents 316 extending outward from the sides 304, 306. The detents 316 define latching features for securing the plug assembly 104 within the header housing 130. Other types of latching features may be used in alternative embodiments. The detents 316 are received in the slots 216 (shown in FIG. 2) to secure the plug assembly 104 within the header housing 130.

The plug housing 140 includes a plurality of open ended channels 318, 320 in the front 300 and the rear 302 at the outer end 308. The open ended channels 318, 320 are aligned with corresponding terminal channels 314. The open ended channels 318, 320 provide openings through the front 300 and the rear 302 that receive the corresponding wires 112 for mating the wire 112 with the corresponding receptacle terminals 142. For example, the wire 112 is loaded in a loading direction, shown by the arrow A, through the outer end 308 of the plug housing 140 and is pressed into the first and second insulation displacement contacts 288, 290 (shown in FIG. 6) at the terminating end 282 (shown in FIG. 6) of the receptacle terminals 142. The open ended channels 318 allow the wires 112 to extend forward from the front 300. The wires 112 are thus allowed to extend generally perpendicular with respect to the terminal axes 144. In an exemplary embodiment, the open ended channels 318, 320 have a wide lead-in and are narrowed at a bottom of the channels 318, 320. Optionally, the bottom of the channels 318, 320 may be sized to pinch the wires 112 to securely hold the wires 112 within the plug assembly 104. In an exemplary embodiment, the channels 318, 320 have detents 322 that extend above the wires 112 to hold the wires 112 at the bottom of the channels 318, 320. The detents 322 stop upward movement of the wires 112.

Figure 8:
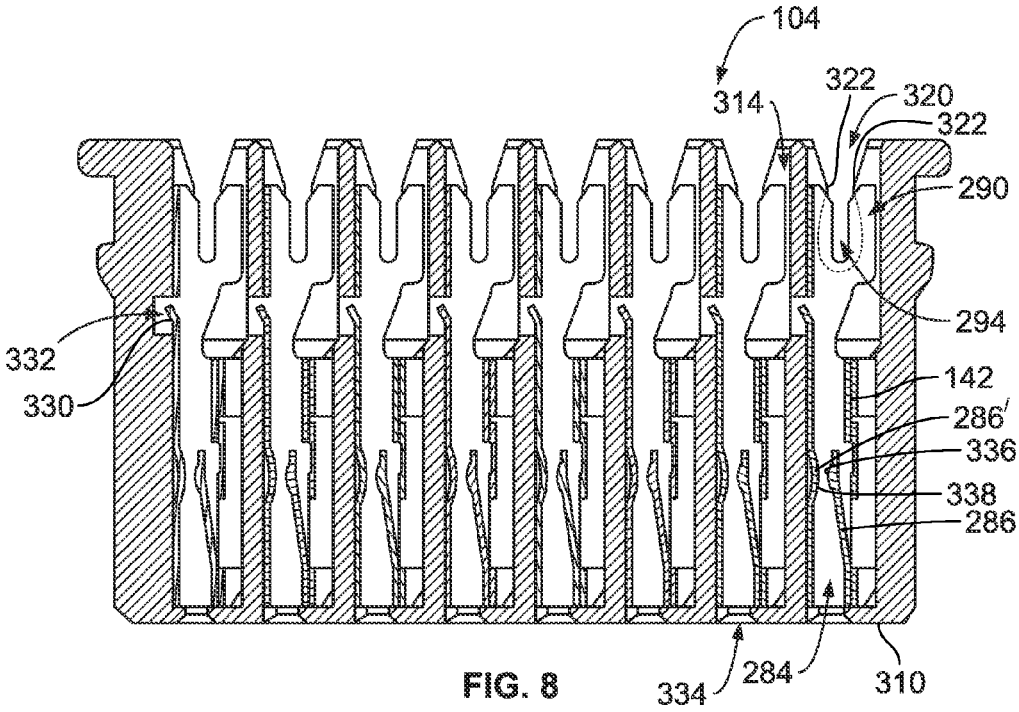
FIG. 8 is a cross sectional view of the plug assembly for the harness connector shown in FIG. 1.

FIG. 8 is a cross sectional view of the plug assembly 104. The receptacle terminals 142 are illustrated loaded into corresponding terminal channels 314. In an exemplary embodiment, the receptacle terminals 142 include locking lances 330 extending from at least one of the walls of the receptacle terminals 142. The locking lances 330 are configured to be received in pockets 332 formed in the interior walls between the terminal channels 314. The locking lances 330 secure the receptacle terminals 142 in the terminals channels 314. In an alternative embodiment, rather than having pockets 332, the locking lances 330 may be pressed against the interior walls to create an interference fit to hold the receptacle terminals 142 and the terminal channels 314.

The terminal channels 314 have an opening 334 at the inner end 310 for receiving the pin 250 (shown in FIG. 5) of the header contact 136 (shown in FIG. 5). As the pin 250 is loaded into the receptacle terminals 142, the mating fingers 286 engage the pin 250. In the illustrated embodiment, the receptacle terminals 142 includes mating fingers 286, 286' on both sides of the receptacle terminals 142 for engaging both the first and second sides 254, 256 (shown in FIG. 5) of the pin 250. One of the mating fingers 286 is cantilevered and is configured to be deflected as the pin 250 is loaded into the receptacle terminals 142. The cantilevered mating finger 286 provides a biasing force against the pin 250 to press the pin 250 against the fixed mating finger 286' on the opposite side of the receptacle terminals 142. The fixed mating finger 286' is formed as a bump or protrusion that is pressed into the socket 284. The mating fingers 286, 286' have mating interfaces 336, 338. In the illustrated embodiment, the mating interfaces 336, 338 are aligned with one another on opposite sides of the receptacle terminals 142. The receptacle terminals 142 may have other features in alternative embodiments for engaging and electrically connecting to the header contact 136.

The insulation displacement contacts 290 are aligned with the open ended channel 320. The tapered lead-ins of the open ended channels 320 are configured to guide the wires 112 into the slots 294. In the illustrated embodiment, the detents 322 are positioned just above the slots 294 to ensure that the wires 112 remains in position with respect to the insulation displacement contacts 290 (e.g., aligned with the slot 294).

Figure 9:
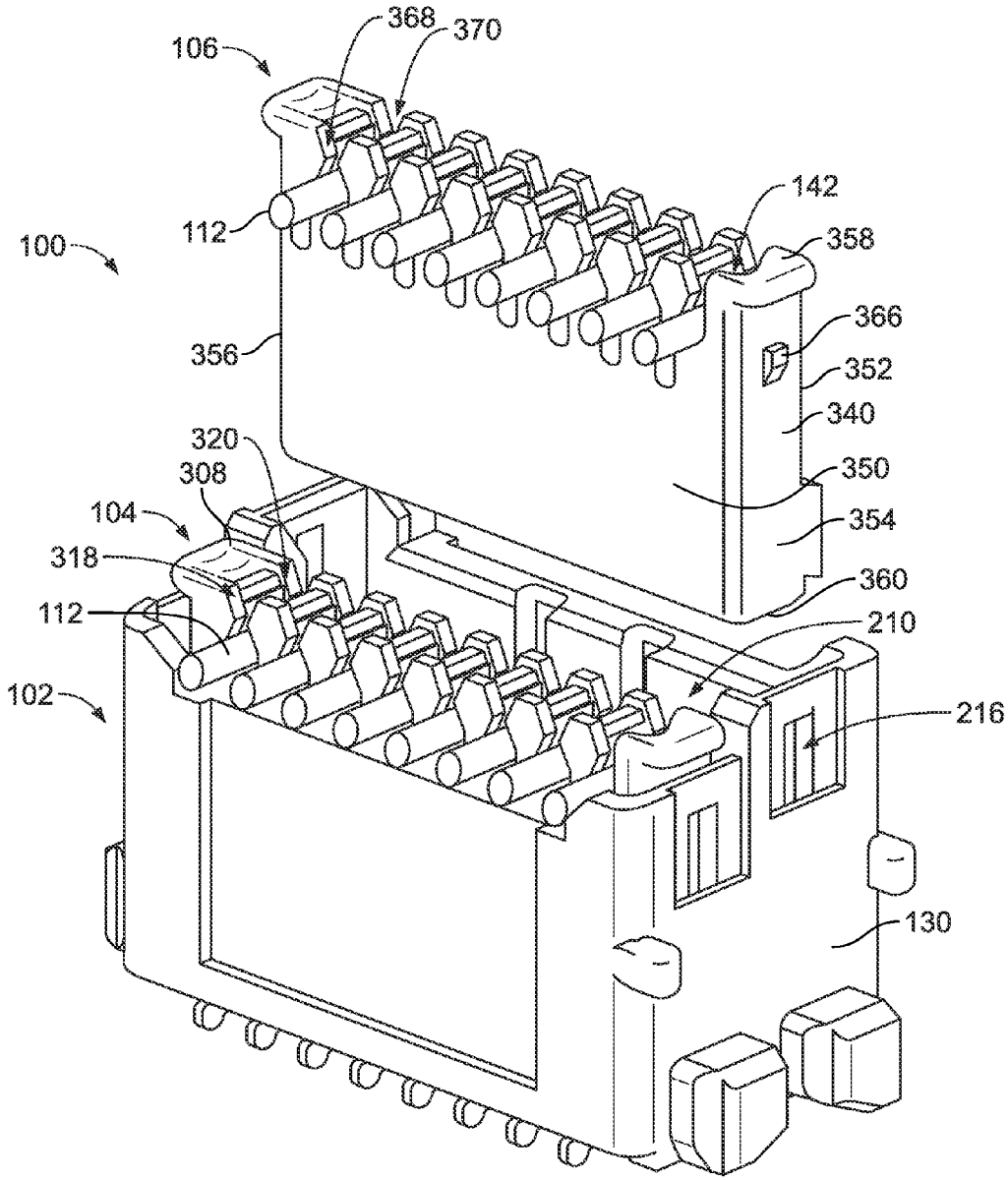
FIG. 9 is a front perspective view of the harness connector shown in FIG. 1.

FIG. 9 is a front perspective view of the harness connector 100 with the second plug assembly 106 poised for loading into the header assembly 102. The second plug assembly 106 includes a plug housing 340 holding a plurality of the receptacle terminals 142. The plug housing 340 has a front 350, a rear 352, and opposite sides 354, 356 extending between the front 350 and the rear 352. The plug housing 340 includes an outer end 358 and inner end 360. The inner end 360 is configured to be plugged into the header housing 130. The plug housing 340 includes detents 366 extending from the sides 354. 356. The detents 366 are configured to be received in the slots 216 in the header housing 130 to secure the plug housing 340 in the second chamber 210. The plug housing 340 includes open ended channels 368, 370 that receive the wire 112. The open ended channels 368, 370 are aligned with the terminating ends 282 (shown in FIG. 6) of the receptacle terminals 142. The open ended channels 368, 370 guide the wires 112 into the insulation displacement contacts 288, 290 (shown in FIG. 6).

During assembly, the first plug assembly 104 is loaded into the header housing 130 prior to the second plug assembly 106 being loaded into the header housing 130. When the second plug assembly 106 is loaded into the header housing 130, the outer end 358 is configured to be elevated above the outer end 308 of the plug housing 140. The wires 112 extending from the front 350 of the plug housing 140 extend above the plug assembly 104. Optionally, the wires 112 extending from the front 350 of the plug housing 340 may extend through the open ended channels 318, 320 of the plug housing 340.

Figure 10:
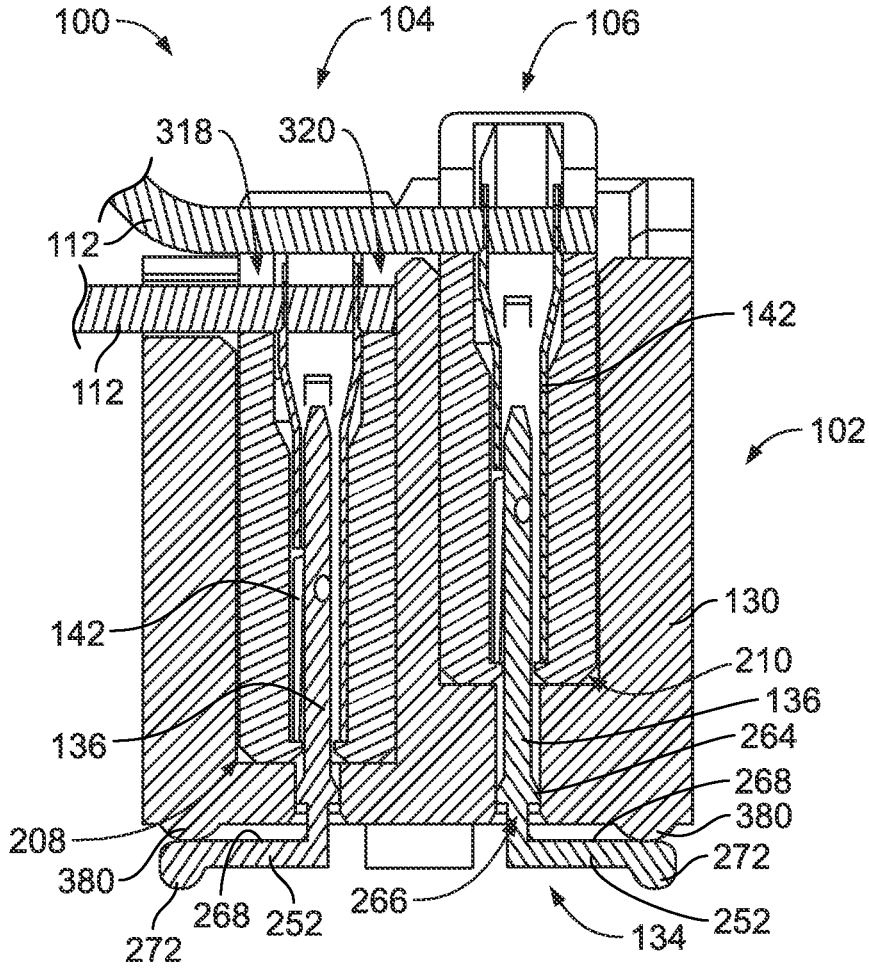
FIG. 10 is a cross sectional view of the harness connector shown in FIG. 1.

FIG. 10 is a cross sectional view of the harness connector 100. The first chamber 208 extends further into the header housing 130 than the second chamber 210. As such, the first plug assembly 104 may be positioned closer to the mounting end 134. The second plug assembly 106 may be elevated slightly above the first plug assembly 104 such that the wires 112 extending from the plug assembly 106 may extend across the top of the first plug assembly 104. Optionally, the wires 112 extending from the second plug assembly 106 may extend through the open ended channels 318, 320 of the plug assembly 104.

When the plug assemblies 104, 106 are loaded into the header assembly 102, the receptacle terminals 142 receive, and are electrically connected to, the header contacts 136. The mating fingers 286 (shown in FIG. 8) of the receptacle terminals 142 engage the first and second sides 254, 256 (shown in FIG. 5) of the header contacts 136.

In an exemplary embodiment, the header housing 130 includes alignment ribs 380 extending from the mounting end 134 of the header housing 130. In the illustrated embodiment, the alignment ribs 380 are bumps or protrusions extending from the mounting end 134. The alignment ribs 380 engage the tops 268 of the tails 252. The alignment ribs 380 hold each of the tails 252 in coplanar alignment with one another. The header contacts 136 are loaded into the header housing 130 and pressed into the header housing 130 until the tails 252 engage the alignment ribs 380. The alignment ribs 380 hold each of the solder tabs 272 in coplanar alignment with one another for mounting to the PCB 120 (shown in FIG. 1). The protrusions 264 engage the header housing 130 to hold the header contacts 136 in the header housing 130. The necked-down portions 266 may be flexed as the header contacts 136 are loaded into the header housing 130. Such flexing ensures that the tails 252 are biased against the alignment rib 380.

Figure 11:
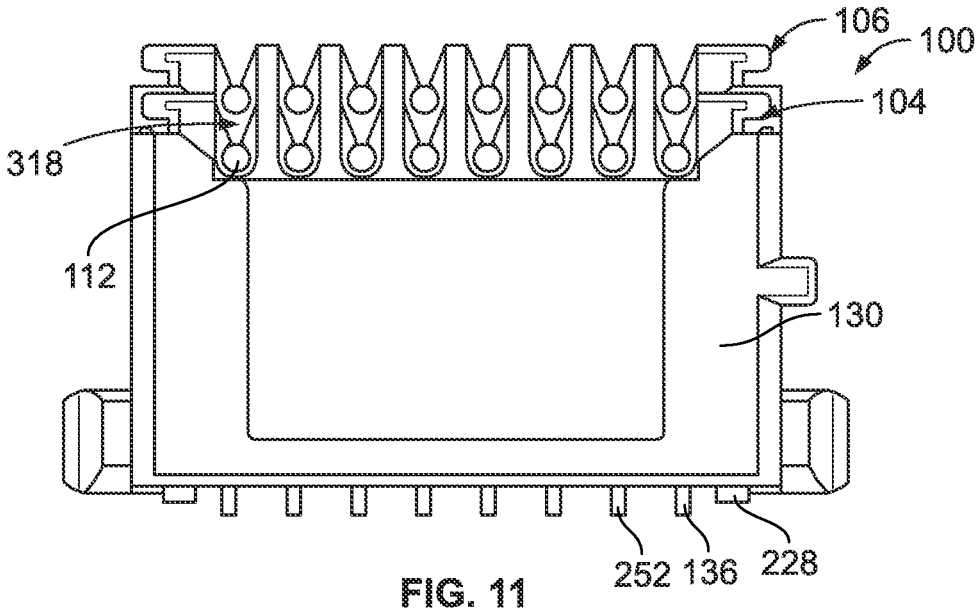
FIG. 11 is a front view of the harness connector shown in FIG. 1.

FIG. 11 is a front view of the harness connector 100. The header contacts 136 are shown as being coplanar for mounting to the PCB 120 (shown in FIG. 1). The mounting pads 228 may be used to help secure the header housing 130 to the PCB 120. Optionally, the solder clips 220 (shown in FIG. 2) may be used to secure the header housing 130 to the PCB 120. When used, the solder clips 220 are oriented generally coplanar with the tails 252 of the header contacts 136 for soldering to the PCB 120.

The plug assembly 106 is shown slightly elevated above the plug assembly 104. The wires 112 extend from both plug assemblies 104, 106 in the same, forward direction. The wires 112 extending from the plug assembly 106 are configured to extend above the plug assembly 104. Optionally, the wires 112 extending from the plug assembly 106 may pass at least partially through the open ended channels 318, 320 (shown in FIG. 6) of the plug assembly 104. Having the plug assemblies 104, 106 arranged in such a manner, and/or by using insulation displacement contacts at the terminating ends, allows the wires to extend from the sides, making the overall vertical height and size of the harness connector 100 smaller. Additionally, by using multiple plug assemblies 104, 106, the components of the harness assembly 100, namely the plug assemblies 104, 106 and the associated wires 112, can fit into tighter spaces, such as through the window mount of the mirror. Having multiple plug assemblies 104, 106 allows the staggering of the plug assemblies 104, 106 in the header housing 130 for better wire management and decreased size.

Figure 12:
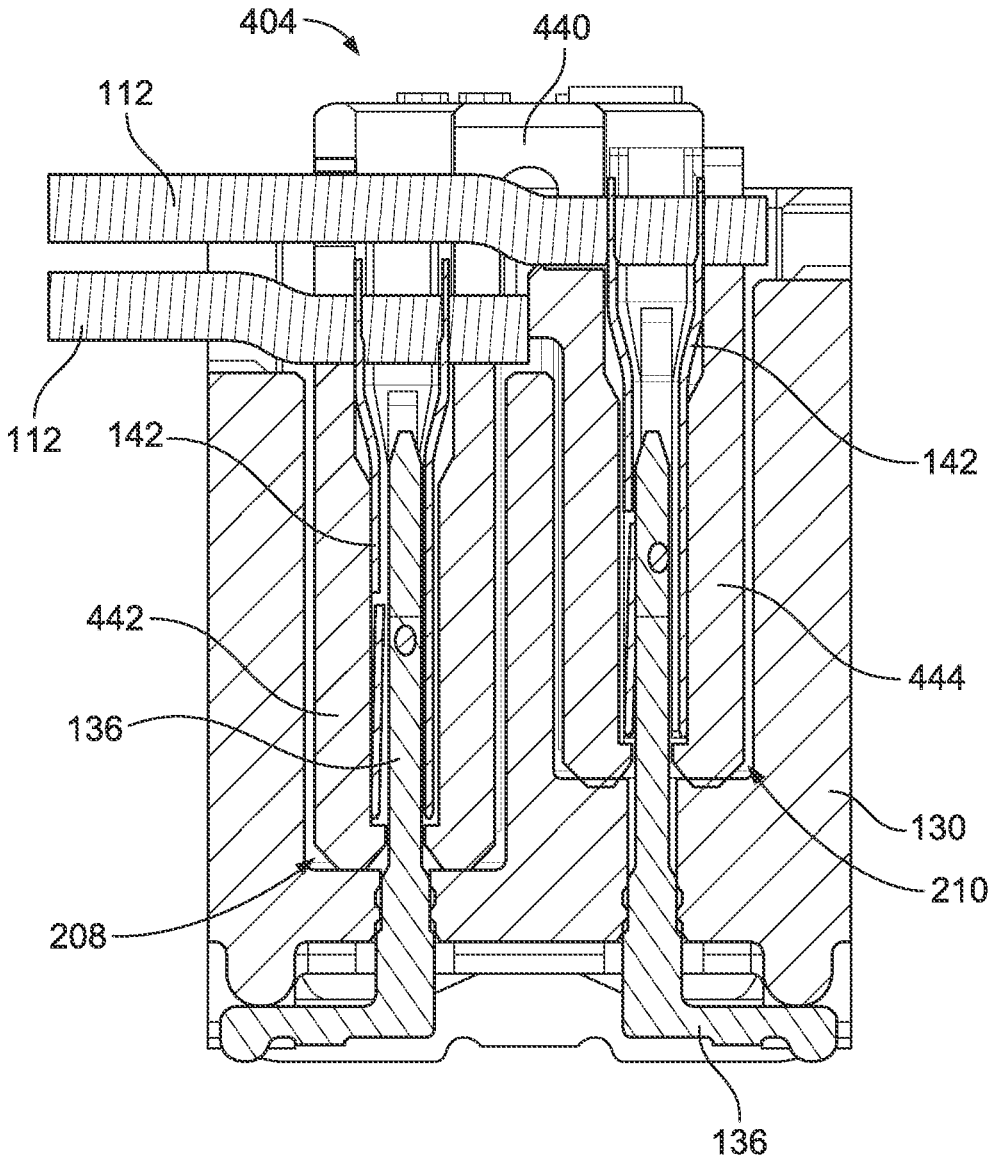
FIG. 12 is a cross sectional view of a plug assembly mated with the header housing shown in FIG. 3.

FIG. 12 is a cross sectional view of a plug assembly 404 loaded into the header housing 130. The plug assembly 404 is essentially a combination of the plug assemblies 104, 106 (shown in FIG. 1). The plug assembly 404 includes a single plug housing 440 having first and second extensions 442, 444 that extend into the first and second chambers 208, 210, respectively. The plug assembly 404 holds a plurality of the receptacle terminals 142 therein. Having a single plug housing 440 allows all of the receptacle terminals 142 to be loaded into the header housing 130, and mated to the corresponding header contacts 136, at the same time, thus reducing assembly time as compared to an embodiment using multiple plug assemblies, such as the plug assemblies 104, 106. However, the plug housing 440 is bulkier than either the plug housing of plug assembly 104 or the plug housing of the plug assembly 106.

In the illustrated embodiment, the second extension 444 is elevated higher than the first extension 442. As such, the receptacle terminals 142 in the second extension 444 are elevated higher than the receptacle terminals 142 in the first extension 442. The wires 112 extend from the receptacle terminals 142 in the same direction, with the wires 112 extending from the receptacle terminals 142 in the second extension 444 being elevated above, and extending over, the receptacle terminals 142 in the first extension 442. The plug assembly 404 holds the receptacle terminals 142 in a staggered relationship with at least one of the receptacle terminals 142 being positioned further from the mounting end of the header housing 130 than at least one other receptacle terminal 142.

Figure 13:
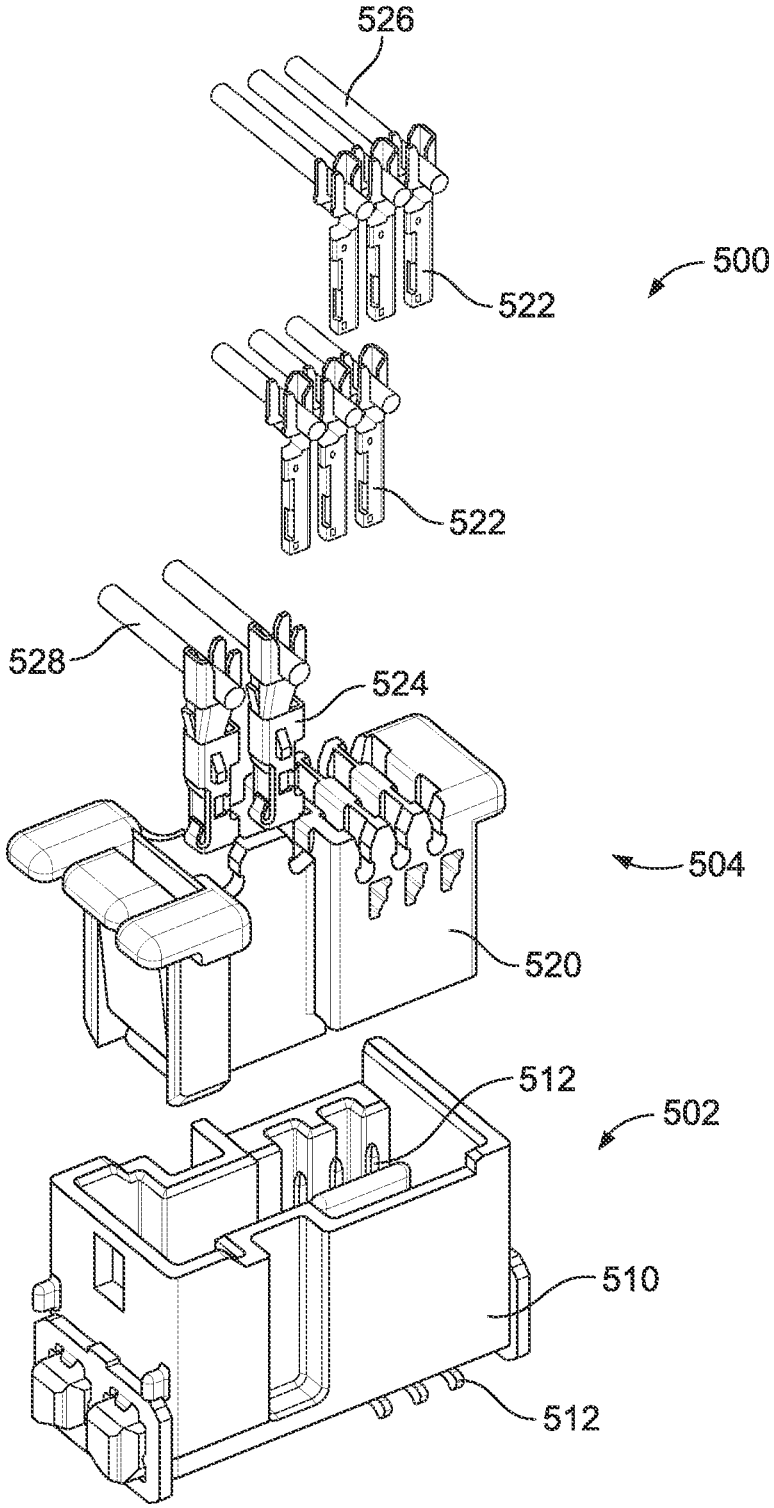
FIG. 13 is an exploded view of a harness connector.

FIG. 13 is an exploded view of a harness connector 500. The harness connector 500 includes a header assembly 502 and a plug assembly 504. The header assembly 502 includes a header housing 510 and a plurality of header contacts 512. The plug assembly includes a plug housing 520, first receptacle terminals 522 and second receptacle terminals 524. The plug housing 520 may be similar to the plug housing 140 (shown in FIG. 7) and include similar features. The first and second receptacle terminals 522, 524 are different than one another. The first and second receptacle terminals 522, 524 are not identical to one another. The first and second receptacle terminals 522, 524 may be different types of terminals.

In the illustrated embodiment, the first receptacle terminals 522 may be substantially similar to, or identical to, the receptacle terminals 142 (shown in FIG. 6). The first receptacle terminals 522 may be loaded into the plug housing 520 in a similar manner as the receptacle terminals 142. Optionally, the first receptacle terminals 522 may be arranged in two rows with one row elevated above the other row such that wires 526 terminated thereto extend above the first receptacle terminals 522 of the other row. The first receptacle terminals 522 may be mated to the header contacts 512 in a similar manner as the receptacle terminals 142. The first receptacle terminals 522 may be terminated to the wires 526 in a similar manner as the receptacle terminals 142.

The second receptacle terminals 524 may be sized and/or shaped differently than the first receptacle terminals 524. In the illustrated embodiment, the second receptacle terminals 524 are larger than the first receptacle terminals 522. Optionally, the second receptacle terminals 524 may be shaped similar to the first receptacle terminals 522, however the second receptacle terminals 524 may be sized larger. In an exemplary embodiment, the second receptacle terminals 524 may constitute power terminals configured to convey power and be terminated to power wires 528, while the first receptacle terminals 522 may constitute signal terminals configured to convey data signals.

The first and second receptacle terminals 522, 524 are loaded into the plug housing 520, and then the plug assembly 504 is plugged into the header assembly 502. While the illustrated embodiment shows a single plug housing 520 holding all of the receptacle terminals 522, 524, multiple plug housings may be used in alternative embodiments. For example, one plug housing may hold the first receptacle terminals 522 while a second plug housing may hold the second receptacle terminals 524. Alternatively, one plug housing may hold any number of first and/or second receptacle terminals 522, 524 while a second plug housing may hold any number of first and/or second receptacle terminals 522, 524.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A harness connector comprising:

a header assembly including a header housing extending between a plug end and a mounting end, the header housing includes alignment ribs extending from the mounting end, the header housing holding header contacts, wherein each header contact is stamped into an L-shape to include a pin and a tail extending generally perpendicular to the pin, the stamped header contacts each include first and second sides and shear edges extending between the first and second sides, a shear edge along the tail being configured to be surface mounted to a printed circuit board, the alignment ribs engaging the other shear edge of each tail to align the tails for surface mounting to the printed circuit board; and a plug assembly received in the plug end of the header housing along a plug axis, the plug assembly including a plug housing holding receptacle terminals, the receptacle terminals extending along and receiving the header contacts along terminal axes, the terminal axes being generally parallel to the plug axis, the mating ends being mated with corresponding header contacts, the terminating ends having insulation displacement contacts configured to receive, and be electrically connected to, corresponding wires, the wires received in the insulation displacement contacts along wire axes that are generally perpendicular to the plug axis and the terminal axes, and the wires extending from the insulation displacement contacts along the wire axes.

2. The harness connector of claim 1, wherein the insulation displacement contacts define slots configured to receive corresponding wires.

3. The harness connector of claim 1, wherein each terminating end has a first insulation displacement contact defining a first slot and a second insulation displacement contact defining a second slot, the first and second slots being aligned along the wire axis of the wire terminated to the corresponding receptacle terminal, the wire being received in both the first and second slots of the corresponding receptacle terminal.

4. The harness connector of claim 1, wherein the plug housing includes a front and a rear extending between an outer end and an inner end, the inner end being plugged into the header housing, the front and rear extending parallel to the terminal axes, the plug housing having a plurality of open ended channels in the front and rear at the outer end, the insulation displacement contacts receiving the wires through the open ended channels, the wires extending from the front.

5. The harness connector of claim 1, wherein the plug housing includes a front and a rear extending between an outer end and an inner end, the inner end being plugged into the header housing, the front and rear extending parallel to the terminal axes, the wire axes being oriented generally perpendicular to the front and the rear.

6. The harness connector of claim 1, further comprising a second plug assembly received in the plug end of the header housing.

7. The harness connector of claim 1, further comprising a second plug assembly received in the plug end of the header housing in a staggered relationship, the second plug assembly being positioned further from the mounting end of the header housing than the other plug assembly, the wires extending from the second plug assembly extending over the other plug assembly.

8. The harness connector of claim 1, wherein the plug assembly holds the receptacle terminals in a staggered relationship with at least one of the receptacle terminals being positioned further from the mounting end than at least one other receptacle terminal.

9. The harness connector of claim 1, wherein the receptacle terminals include a first receptacle terminal and a second receptacle terminal that is not identical to the first receptacle terminal.

10. The harness connector of claim 1, wherein the header housing includes epoxy pads extending from the mounting end, epoxy being applied to the epoxy pads to secure the header housing to a printed circuit board.

11. The harness connector of claim 1, wherein the receptacle terminals include sockets at the mating ends, the header contacts being received in the sockets, the receptacle terminals including mating fingers extending into the sockets to engage corresponding header contacts.

12. The harness connector of claim 1, wherein the receptacle terminals include sockets at the mating ends, the pins of the header contacts being received in the sockets, the receptacle terminals including mating fingers extending into the sockets to engage the header contacts, the receptacle terminals being oriented in the plug housing such that the mating fingers engage one of the first side or the second side and do not engage the shear edges.

13. The harness connector of claim 1, wherein the plug assembly includes an outer end, a space being defined along a side of the header assembly and plug assembly bounded at a bottom by a plane extending from the mounting end of the header assembly and bounded at a top by a plane extending from the outer end of the plug assembly, the wires extending from the plug assembly within the space between the plane extending from the outer end of the plug assembly and the plane extending from the mounting end of the header assembly.

14. A harness connector comprising:

a header assembly including a header housing extending between a plug end and a mounting end, the header housing having a first plug chamber and a second plug chamber extending between the plug end and the mounting end, the header housing holding header contacts in the first and second plug chambers;

a first plug assembly received in the first plug chamber through the plug end of the header housing along a plug axis; and a second plug assembly received in the second plug chamber through the plug end of the header housing along a plug axis;

the first and second plug assemblies each including a plug housing holding receptacle terminals, the receptacle terminals extending along terminal axes parallel to the corresponding plug axis between mating ends and terminating ends, the mating ends being mated with corresponding header contacts, the terminating ends having insulation displacement contacts configured to receive, and be electrically connected to, corresponding wires, the wires being received in, and extending from, the insulation displacement contacts along wire axes that are generally perpendicular to the plug axis and the terminal axes;

wherein the first and second plug assemblies are received in the first and second plug chambers in a staggered relationship with the second plug assembly being positioned further from the mounting end of the header housing than the first plug assembly, the first and second plug assemblies being received in the first and second plug chambers such that the second plug assembly does not pass vertically over any portion of the first plug assembly and such that the first plug assembly does not pass vertically over any portion of the second plug assembly, the wires extending from the second plug assembly extending over the plug housing of the first plug assembly; and wherein the plug housings each include a front and a rear extending between an outer end and an inner end, the inner end being plugged into the header housing, the front and rear extending parallel to the terminal axes, the wires extending from the front of the plug housing of the first plug assembly, the wires extending from the front of the plug housing of the second plug assembly over the outer end of the plug housing of the first plug assembly.

15. The harness connector of claim 14, wherein the insulation displacement contacts define slots configured to receive corresponding wires.

16. The harness connector of claim 14, wherein each terminating end has a first insulation displacement contact defining a first slot and a second insulation displacement contact defining a second slot, the first and second slots being aligned along the wire axis of the wire terminated to the corresponding receptacle terminal, the wire being received in both the first and second slots of the corresponding receptacle terminal.

17. The harness connector of claim 14, wherein each plug housing has a plurality of open ended channels in the front and rear at the outer end, the insulation displacement contacts receiving the wires through the open ended channels.

18. The harness connector of claim 14, wherein the receptacle terminals include sockets at the mating ends, the header contacts being received in the sockets, the receptacle terminals including mating fingers extending into the sockets to engage corresponding header contacts.

* * * * *